US005142799A

United States Patent [19]

Wood

[11] Patent Number: 5,142,799

[45] Date of Patent: Sep. 1, 1992

[54] TRACTOR BACKHOE ATTACHMENT

[76] Inventor: Kennith L. Wood, Box 51, Bloomfield, N. Mex. 87413

[21] Appl. No.: 797,414

[22] Filed: Nov. 21, 1991

[51] Int. Cl.[5] ..... E02F 3/96

[52] U.S. Cl. ..... 37/117.5; 37/DIG. 12; 37/DIG. 19; 37/103; 414/912

[58] Field of Search ..... 37/103, 117.5, DIG. 3, 37/DIG. 12, DIG. 19; 414/724, 912

[56] References Cited

U.S. PATENT DOCUMENTS 3,749,262 7/1973 Stark ..... 414/724
3,989,404 11/1976 Burton ..... 37/DIG. 3 X
4,172,687 10/1979 Schultz ..... 414/724
4,189,854 2/1980 Haynes ..... 414/724 X

*Primary Examiner*—Randolph A. Reese
*Assistant Examiner*—Arlen L. Olsen
*Attorney, Agent, or Firm*—Leon Gilden

[57] ABSTRACT

An attachment for securement to a bucket portion of a tractor is provided to include a mounting plate, with the mounting plate including hooks securable to a lower wall of the bucket and straps extending from a rear edge of the mounting plate to an upper wall of the bucket. A support leg extends orthogonally and downwardly relative to the mounting plate, with a scoop fixedly and orthogonally secured to the lower distal end of the support leg defining a scoop entrance oriented one hundred eighty degrees relative to an entrance of the bucket.

5 Claims, 4 Drawing Sheets

TRACTOR BACKHOE ATTACHMENT

BACKGROUND OF THE INVENTION

1. Field of the Invention

The field of invention relates to tractor apparatus, and more particularly pertains to a new and improved tractor backhoe attachment wherein the same is arranged for the adaption of a tractor scoop as a backhoe.

2. Description of the Prior Art

Various attachments of types to accommodate particular situations are available in the prior art. Backhoe apparatus is available in the prior art and exemplified in U.S. Pat. No. 4,808,061 to Cook, et al. illustrating the use of a single arm backhoe apparatus.

U.S. Pat. No. 4,704,811 to Jefferson sets forth a trenching attachment for mounting to a backhoe to provide for "V" shaped plates to effect trenching.

U.S. Pat. No. 4,820,112 to Mullican sets forth a claw attachment for backhoes for use in excavation.

U.S. Pat. No. 4,890,400 to Long sets forth a bucket attachment for mounting to a tractor blade oriented forwardly of the tractor blade for utilization as a front-end loader type device.

As such, it may be appreciated that there continues to be a need for a new and improved tractor backhoe attachment as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of tractor apparatus now present in the prior art, the present invention provides a tractor backhoe attachment wherein the same is arranged to permit utilization of a tractor and associated bucket in a backhoe type excavation procedure. As such, the general purpose of the present invention, which will be described subsequently in greater detail, is to provide a new and improved tractor backhoe attachment which has all the advantages of the prior art tractor apparatus and none of the disadvantages.

To attain this, the present invention provides an attachment for securement to a bucket portion of a tractor to include a mounting plate, with the mounting plate including hooks securable to a lower wall of the bucket and straps extending from a rear edge of the mounting plate to an upper wall of the bucket. A support leg extends orthogonally and downwardly relative to the mounting plate, with a scoop fixedly and orthogonally secured to the lower distal end of the support leg defining a scoop entrance oriented one hundred eighty degrees relative to an entrance of the bucket.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tractor backhoe attachment which has all the advantages of the prior art tractor apparatus and none of the disadvantages.

It is another object of the present invention to provide a new and improved tractor backhoe attachment which may be easily and efficiently manufactured and marketed.

It is a further object of the present invention to provide a new and improved tractor backhoe attachment which is of a durable and reliable construction.

An even further object of the present invention is to provide a new and improved tractor backhoe attachment which is susceptible of a low cost of manufacture with regard to both materials and labor, and which accordingly is then susceptible of low prices of sale to the consuming public, thereby making such tractor backhoe attachments economically available to the buying public.

Still yet another object of the present invention is to provide a new and improved tractor backhoe attachment which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
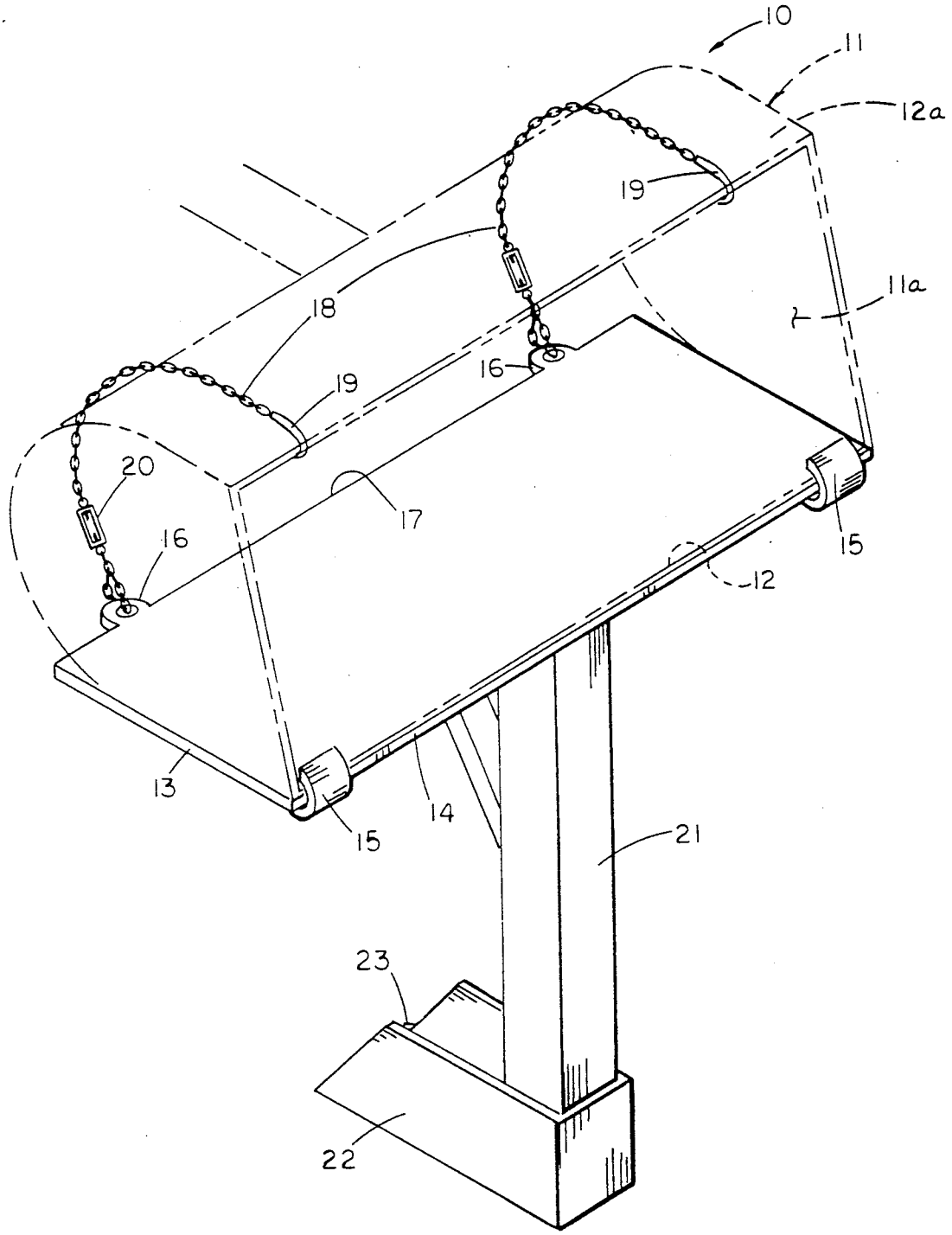
FIG. 1 is an isometric illustration of the instant invention.

With reference now to the drawings, and in particular to FIGS. 1 to 8 thereof, a new and improved tractor backhoe attachment embodying the principles and concepts of the present invention and generally designated by the reference numerals 10, 10*a*, and 10*b* will be described.

More specifically, the tractor backhoe attachment 10 of the instant invention essentially comprises a tractor bucket 11 formed with a bucket entrance 11*a* defined by a bottom wall 12 and a top wall 12*a*, each including parallel and respective lower and upper edges. The apparatus includes a mounting plate 13 that is arranged for a coextensive and contiguous positioning relative to an exterior surface of the bottom wall 12, with a mounting plate forward edge 14, including a plurality of spaced hook members 15 fixedly mounted to the forward edge 14 extending upwardly relative to the mounting plate 13 receiving the bottom wall lower edge within the hook members 15. A plurality of spaced loop plate members 16 that are coplanar with the mounting plate 13 and extend rearwardly of the mounting plate rear edge 17 each include openings to each receive a tether cable or strap therethrough at a rear distal end of each tether cable 18, with a forward distal end of each tether cable 18 including a tether cable hook 19 arranged for mounting about the upper edge of the top wall 12*a*. A tether cable 18 includes an adjuster block 20, such as a turnbuckle to effect tensioning of each cable relative to the bucket 11 to insure securement of the mounting plate relative to the tractor bucket bottom wall 12. A support leg 21 fixedly and orthogonally extends downwardly relative to the mounting plate 13, with a lower distal end of the support leg 21 including a scoop 22 removably secured thereto, with the scoop including a scoop entrance 23 oriented one hundred eighty degrees relative to the bucket entrance 11*a*.

Figure 2:
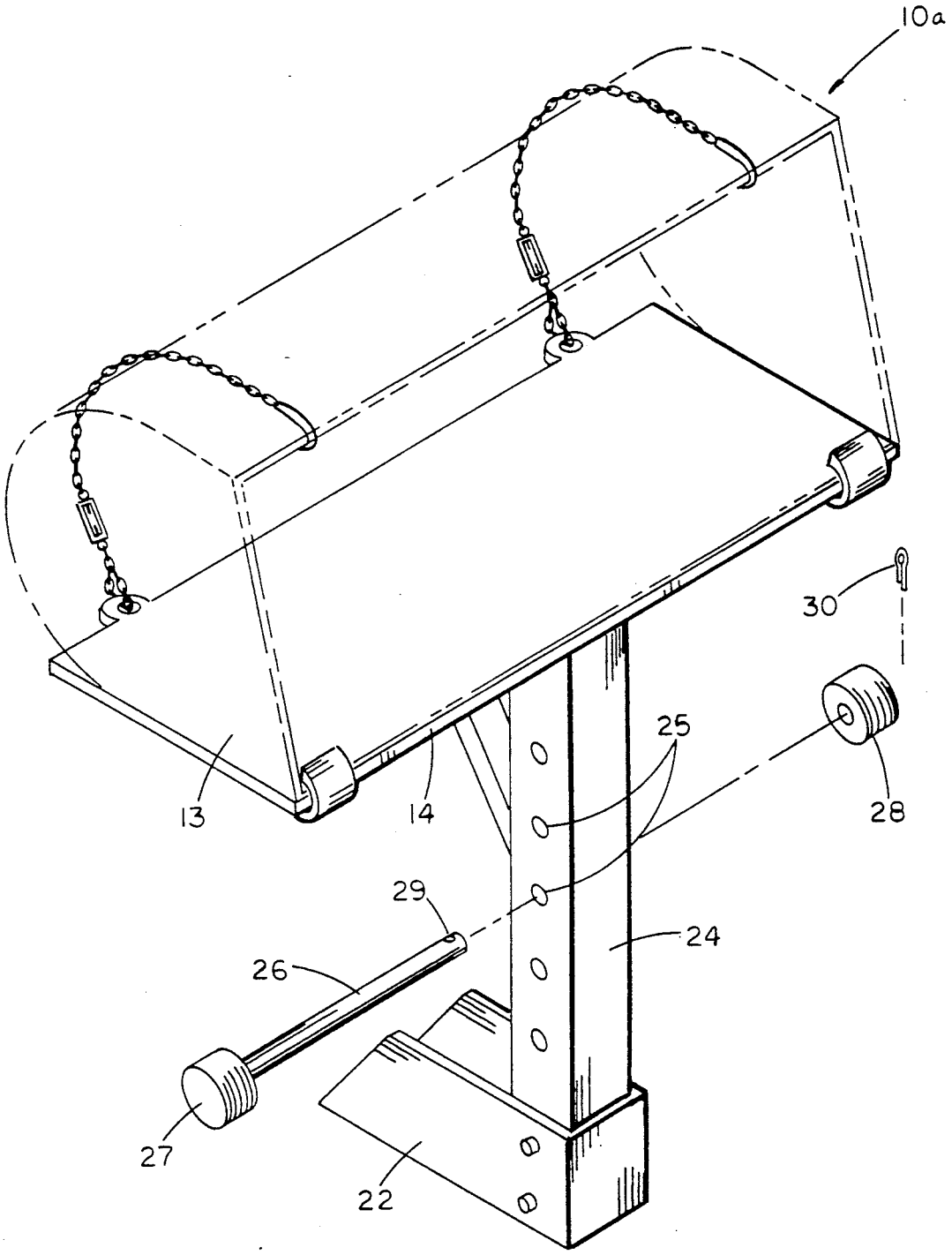
FIG. 2 is an isometric illustration of a modification of the instant invention.
Figure 3:
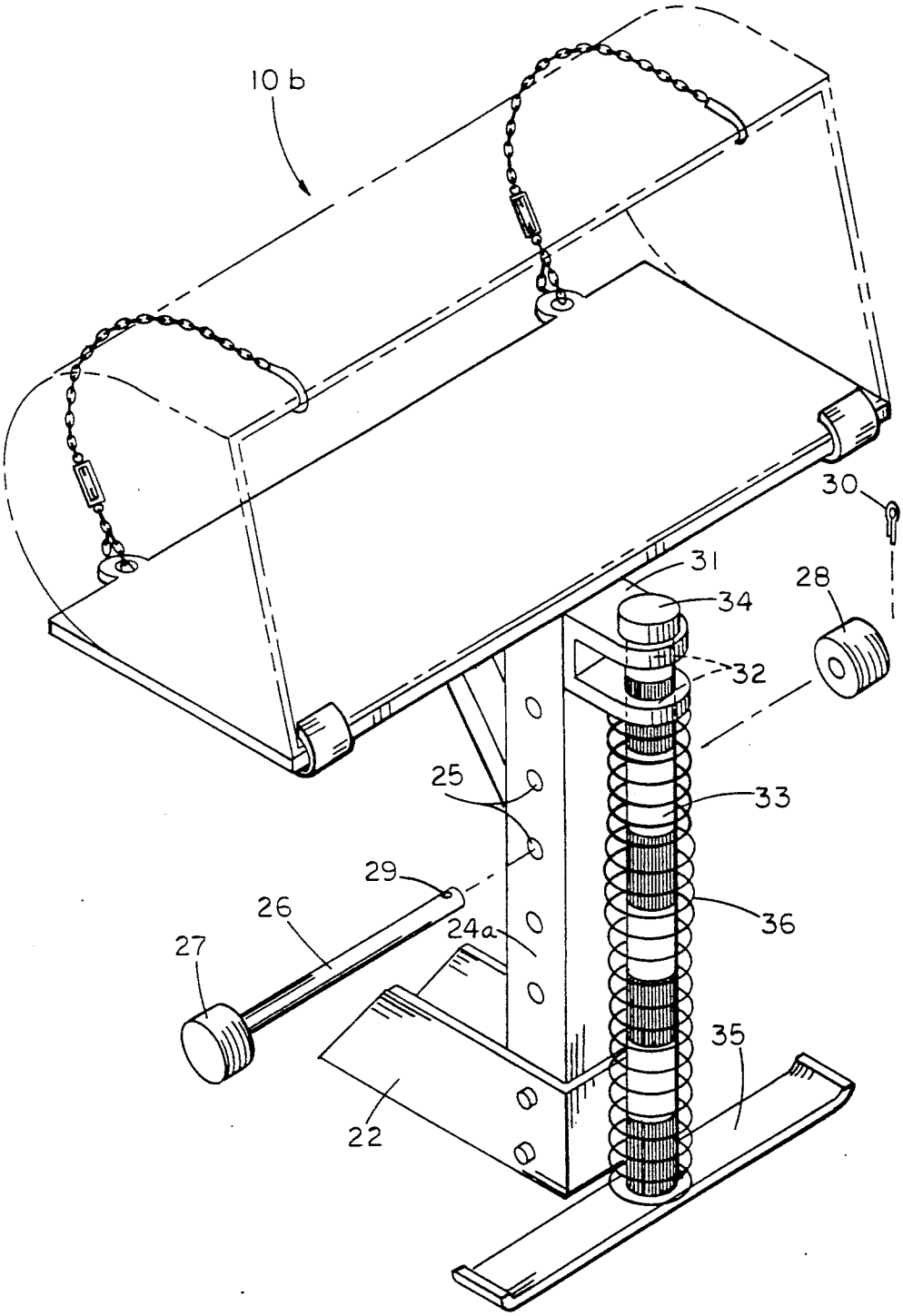
FIG. 3 is an isometric illustration of a further modification of the invention.
Figure 4:
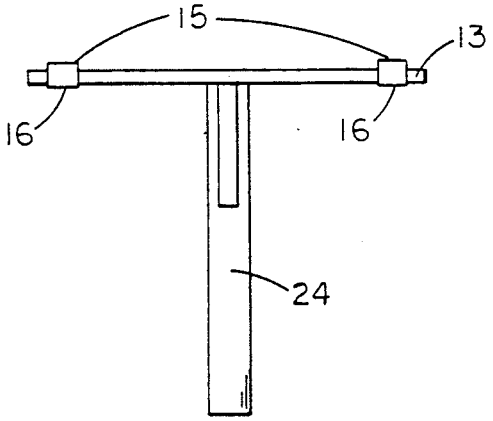
FIG. 4 is an orthographic rear view of the mounting plate and support leg structure.
Figure 5:
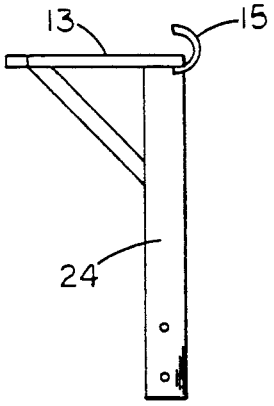
FIG. 5 is an orthographic side view of the mounting plate and support leg structure.

FIG. 2 illustrates a modified attachment 10*a*, including a modified support leg 24 mounted in a manner as described above, but wherein the modified support leg 24 includes a plurality of support leg bores 25 oriented parallel relative to one another in an aligned row orthogonally directed through the support leg 24 in an orientation parallel relative to the mounting plate forward edge 13. In this manner, an adjustment axle 26 is slidably received through one of the through-extending leg bores 25, with the adjustment axle including a first head 27 fixedly mounted to a first end of the axle, with a second head 28 slidably receiving the axle therethrough. The axle includes an axle bore 29 directed orthogonally through the axle adjacent a second end thereof to receive a lock pin 30 positioned exteriorly of the second head 28 to capture the second head between the support leg 24 and the lock pin 30. In this manner, the axle and first and second heads function as a depth limiting abutment to minimize or control depth of the scoop 22 directed into an excavation site.

Figure 6:
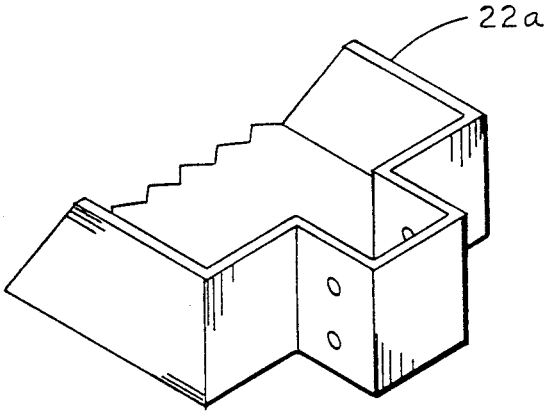
FIG. 6 is an isometric illustration of a modified scoop structure utilized by the invention.
Figure 7:
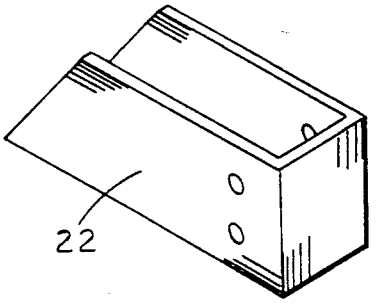
FIG. 7 is an isometric illustration of the scoop organization utilized by the invention.
Figure 8:
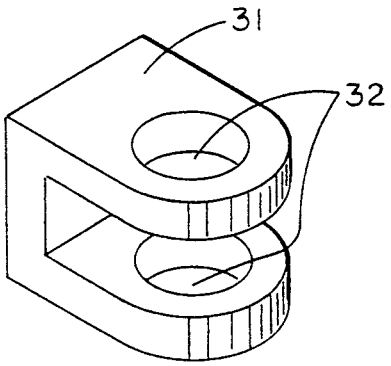
FIG. 8 is an isometric illustration of the guide bracket utilized by the invention, as set forth in FIG. 3.

A further modified support leg 24*a* is illustrated in the modified apparatus 10*b* that additionally includes a bifurcated guide bracket 31 mounted to a forward wall of the support leg adjacent an upper distal end thereof positioned and oriented medially of the forward edge 14 to slidably receive through bracket bores 32 whose axes are parallel relative to the support leg 24 a graduated indicator rod 33. The indicator rod 33 includes a rod head 34 mounted at an upper distal end thereof preventing removal of the rod 33 from the bracket 31, with a lower distal end of the rod including a rod presser foot plate 35 orthogonally mounted to the lower distal end to capture a spring 36 between the guide bracket 31 and the foot plate 35. Upon projection of the scoop 22 into an underlying surface, the presser foot 35 projects upwardly, wherein visual indication is effected by projection of the graduated rod 33 upwardly, whereupon an operator may visually perceive or an assistant to that effect the depth of the scoop 22 when projected into an underlying ground surface. The FIG. 6 illustrates the use of a modified scoop 22*a* formed with a serrated forward edge. FIG. 8 illustrates the bracket bores 32 in a clarified manner as utilized in the organization of FIG. 3.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tractor backhoe attachment for securement to a tractor bucket, wherein the tractor bucket includes a bucket entrance, including a bucket bottom wall spaced from a bucket top wall, the bucket bottom wall including a bottom wall lower edge and the bucket top wall including a top wall upper edge, wherein the lower edge and upper edge are arranged in a parallel relationship, and wherein the apparatus comprises, a mounting plate, the mounting plate is arranged for securement in a coextensive relationship relative to an exterior surface of the bucket bottom wall, and wherein the mounting includes a mounting plate forward edge spaced from a mounting plate rear edge, the mounting plate forward edge includes first securement means for securement of the mounting plate to the bucket bottom wall lower edge, and second securement means secured to the mounting plate rear edge for securement of the mounting plate to the bucket top wall upper edge, and a support leg fixedly and orthogonally mounted to a bottom surface of the mounting plate extending downwardly therefrom, wherein the support leg includes a support leg lower distal end, and a scoop detachably mounted to the support leg lower distal end.

2. An apparatus as set forth in claim 1 wherein the scoop includes a scoop entrance, and the scoop entrance is oriented one hundred eighty degrees relative to the bucket entrance.

3. An apparatus as set forth in claim 2 wherein the first securement means includes a plurality of spaced hook members, each hook member is fixedly mounted to the mounting plate forward edge and extends upwardly relative to the forward edge for reception of the bottom wall lower edge, and the second securement means includes a plurality of spaced loop plate members, each plate member is arranged coplanar with the mounting plate and wherein each loop plate member includes a tether cable, the tether cable includes a lower distal end mounted to a respective loop plate member of said loop plate members, and a forward distal end of each tether cable includes a tether cable hook, each tether cable hook is arranged for reception of the tractor bucket top wall upper edge therewithin, and each tether cable includes an adjuster member for effecting tensioning of the tether cable when secured to the tractor bucket top wall upper edge.

4. An apparatus as set forth in claim 3 wherein the support leg includes a plurality of support leg bores directed therethrough, the support leg bores are arranged in a parallel aligned relationship relative to one another and oriented parallel relative to the mounting plate forward edge, and a depth adjustment axle arranged for sliding reception through one of said support leg bores, wherein the adjustment axle includes a first head mounted to a first distal end of the axle fixedly thereto, and a second distal end of the axle includes an axle bore directed through the axle adjacent the second distal end, and a second head is arranged for sliding reception of the second distal end therethrough, and a lock pin is arranged for projection through the axle bore to capture the second head between the lock pin and the support leg.

5. An apparatus as set forth in claim 4 including a bifurcated guide bracket mounted to a forward wall of the support leg, the guide bracket includes at least one bracket bore, the bracket bore includes a bracket bore axis oriented parallel to the support leg, and a graduated indicator rod slidably directed through the at least one bracket bore, the indicator rod includes a rod head mounted to an upper distal end of the indicator rod above the guide bracket, and a lower distal end of the indicator rod includes a presser foot plate, the presser foot plate is fixedly and orthogonally mounted to the lower distal end of the indicator rod, and a spring is captured between the bracket and the presser foot plate.

* * * * *